United States Patent [19]

Flowers et al.

[11] Patent Number: 4,947,054

[45] Date of Patent: Aug. 7, 1990

[54] SLIDING DIMMER SWITCH

[75] Inventors: Woodie Flowers, Weston, Mass.; Gary Bryde, Catasaqua, Pa.

[73] Assignee: Lutron Electronics Co., Inc., Coopersburg, Pa.

[21] Appl. No.: 332,254

[22] Filed: Mar. 31, 1989

Related U.S. Application Data

[63] Continuation-in-part of Ser. No. 225,974, Jul. 29, 1988, abandoned.

[51] Int. Cl.[5] ..... H01C 10/38; H05B 37/02

[52] U.S. Cl. ..... 307/125; 200/547; 338/176; 338/200

[58] Field of Search ..... 307/112, 115, 125, 130, 307/131; 338/172, 176, 179, 198–200; 200/330, 335, 547, 5 E, 16 C, 16 A, 16 R

[56] References Cited

U.S. PATENT DOCUMENTS

| | | | |
|---|---|---|---|
| 3,746,923 | 7/1973 | Spira et al. | 338/198 |
| 4,042,903 | 8/1977 | Finegan, Jr. | 338/159 |
| 4,104,606 | 8/1978 | DeWitt | 338/198 |
| 4,363,018 | 12/1982 | Matsui et al. | 338/198 X |
| 4,504,818 | 3/1985 | Okuya et al. | 338/119 |
| 4,563,592 | 1/1986 | Yuhasz et al. | 307/115 |
| 4,672,229 | 6/1987 | Skarman et al. | 307/115 |
| 4,695,820 | 9/1987 | D'Aleo et al. | 338/198 |
| 4,742,188 | 5/1988 | Buehler et al. | 338/198 |
| 4,873,403 | 10/1989 | Counts et al. | 307/115 |

OTHER PUBLICATIONS

Home Automation Catalog, Jan. 1984–p. 7.

Lutron Electronics Co.-D-600P Brochure P/N 362-009.

Lutron Electronics Co.-Skylark® Brochure P/N 362-168.

Lutron Electronics Co.-Nova® Brochure P/N 360-110.

*Primary Examiner*—Philip H. Leung

*Assistant Examiner*—Jeffrey A. Gaffin

[57] ABSTRACT

A system for controlling power to an electrical load includes a linear slide dimmer and a switch, whose pushbutton actuator moves up and down with the dimmer slider. When the pushbutton is depressed, to actuate the switch, it rides in and out in the slider. The slider only moves up and down. In one embodiment, a light is visible through the pushbutton in a darkened environment. In another embodiment, a wallbox-mountable switch assembly includes a pushbutton-actuated, alternate-action mechanical power switch whose pushbutton, when depressed, moves within a bezel that is attached to the switch support.

48 Claims, 8 Drawing Sheets

SLIDING DIMMER SWITCH

CROSS-REFERENCE TO PRIOR APPLICATION

This application is a continuation-in-part of copending U.S. Appl. Ser. no. 225,974 filed July 29, 1988 abandoned.

BACKGROUND OF THE INVENTION

1. Field of the Invention

This invention relates to a sliding dimmer control with an associated switch.

2. Description of the Related Art

Wallbox-mountable dimmers, switches, and combination dimmers and switches have been known for many years. A slide dimmer was disclosed in U.S. Pat. No. 3,746,923, issued July 17, 1973, to Spira et al., and a dimmer of the type disclosed—Nova® linear slide dimmer—is sold by Lutron Electronics Co. Toggle switches are the most common type of wallbox-mounted switch for lighting control, but other types are known, as well. A wallbox-mountable touch switch was disclosed in U.S. Pat. No. 4,563,592, issued Jan. 7, 1986, to S. J. Yuhasz et al., and a switch of the type disclosed—Nova® electronic touch switch—is sold by Lutron Electronics Co.

Combination dimmer-and-switch devices are of two types. In the first type, the switch function is accomplished by operation of the dimmer control. For example, a rotary dimmer can be pushed to operate as a switch or turned to operate as a dimmer. Alternatively, a linear slide dimmer can be designed to operate a switch at the low end of its travel. (See U.S. Pat. No. 3,746,923, referred to above).

The second type of combination dimmer/switch device includes separate actuators for the dimmer and switch functions. Examples of this device are Lutron's Skylark® Model S600P and Nova® Model N-600ML. Another example of this device is available from Home Automation Ltd., in the U.K., and consists of a linear slide dimmer mounted beside a rocker switch (Slider Dimmer Model SC630W ID). The dimmer and switch actuators are mounted side-by-side, each occupying half of a rectangular opening in a faceplate.

Nowhere in these references is there disclosed a linear slide dimmer on whose slider is mounted a pushbutton switch that permits a load to be turned on to a preset power level determined by the slider position.

Lighted switches of various types, including toggle and pushbutton switches, are well known in the art. A combination light dimmer and push switch, having a lighted knob (sold under the trademark "Dim-N-Glo"), is sold by Lutron Electronics Co. Lutron also sells the Grafik Eye™ Preset Dimming Control, which includes a "hidden" night light; i.e., a light that shines through a translucent cover and is only visible in a darkened environment.

SUMMARY OF THE INVENTION

The present invention provides a dimmer-and-switch system for controlling power to an electrical load, in which (a) said dimmer comprises a sliding member positionable linearly along a first direction for determining the power provided to said load, (b) said switch comprises a pushbutton-actuated switch and means for transmitting a force applied to said pushbutton to actuate said switch, and (c) said pushbutton moves with said sliding member along said first direction and is actuated by being pushed in a second direction, substantially normal to said first direction.

The present invention is particularly adapted to wallbox-mounted lighting controls, where the system provides convenient slide dimming to a desired intensity and pushbutton on/off control in a single, compact unit.

Another embodiment provides a hidden night light on a wallbox-mountable device for controlling power to an electrical load. The device comprises, in combination, (a) a dimmer that includes a manually-movable member for determining the power provided to said load, (b) a switch means that includes a pushbutton and a switch, said pushbutton adapted for moving with said manually-movable member in a first direction and for actuating said switch by being pushed in a second direction, substantially normal to said first direction and (c) a light source for providing light through said pushbutton in said second direction.

In another embodiment of this invention, a wallbox-mountable device for controlling power to an electrical load comprises in combination, (a) a switch means that includes a pushbutton and a switch, (b) a potentiometer that includes a manually movable member for determining the power provided to said load, and (c) a pivoted hinge bar for transmitting a force applied to said pushbutton to actuate said switch, said movable member being adapted for moving with said pushbutton along said hinge bar.

Another embodiment provides a wallbox-mountable device for controlling power to an electrical load that comprises, in combination, (a) a switch means that includes a pushbutton and a switch, (b) a potentiometer that includes a member manually movable in a first direction for determining the power provided to said load, and (c) means for transmitting a force applied to said pushbutton to actuate said switch, said force transmitting means including a fixed elongated slot, having a long direction that is substantially normal to said first direction, and a frame means constrained to move in said slot, said movable member being adapted for moving with said pushbutton along said frame means.

In another embodiment, a wallbox-mountable device for controlling power to an electrical load comprises, in combination:

(a) a linear slide potentiometer that includes a manually-movable member for determining the power provided to said load, (b) a switch means that includes a pushbutton and a switch, said pushbutton adapted for moving with said manually-movable member in a first direction and for actuating said switch by being pushed in a second direction, substantially normal to said first direction, and (c) rail means deployed along said first direction for transmitting a force applied to said pushbutton to actuate said switch.

In another embodiment, a wallbox-mountable electrical switch assembly comprises, in combination, (a) a pushbutton-actuated, alternate-action mechanical power switch,
(b) means for supporting said switch, attachable to said wallbox,
(c) a faceplate for mounting over said support means, said faceplate having an opening through it,
(d) an extension member extending through said opening and having a first end attached to said support means and a second end attached to a bezel,
(e) a pushbutton, at least part of which is adapted for moving within said bezel, and
(f) means for transmitting a force applied to said pushbutton to actuate said switch.

DETAILED DESCRIPTION OF THE INVENTION

The present invention provides a combination slide dimmer and pushbutton switch for controlling power to an electrical load. As used in this specification and the appended claims, a dimmer is understood to be a device for controlling power to an electrical load that is not limited to being a lighting load.

Figure 1:
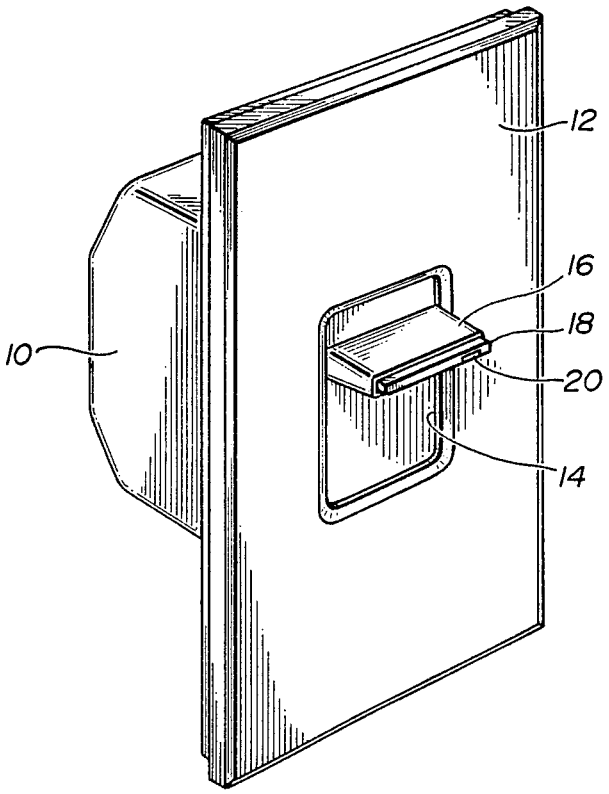
FIG. 1 depicts a combination switch and slide dimmer of this invention.

FIG. 1 depicts a slide dimmer and switch of the present invention. A conventional pushbutton switch and slide dimming control are housed in backbox 10, which is mounted on a support plate (not shown) that is preferably adapted for mounting in a standard wallbox. Faceplate 12 has an opening 14 within which slider 16 is moved to control power to a load. Pushbutton 18 is captured in slider 16 and is depressed to actuate the pushbutton switch. When actuated, pushbutton 18 rides in and out in the slider. The slider does not move in and out; instead it moves in but one direction, up and down. In this specification and the appended claims, "up" and "down" refer to the vertical direction when the dimmer and switch are mounted in a wallbox. Preferably, pushbutton 18 is biased, and the switch is preferably an alternate-action switch. The switch may be a mechanical power switch, directly controlling power to a load, or a short-throw "touch" switch. The latter is a low-force, short-throw switch that includes a controllably conductive device (i.e., an electronic switch), such as a thyristor, transistor, or relay which controls the power to a load. The touch switch directly controls only low-voltage signals. Optional indicator light 20 indicates the status of the load—bright when power is being delivered and dim or off when the power is off. Preferably, indicator light 20 is an LED. An aesthetic advantage of the embodiment of FIG. 1 is that only slider 16, pushbutton 18, and faceplate 12 are visible from the front of the faceplate, unlike the situation for the embodiment of FIG. 2, discussed below.

Figure 2:
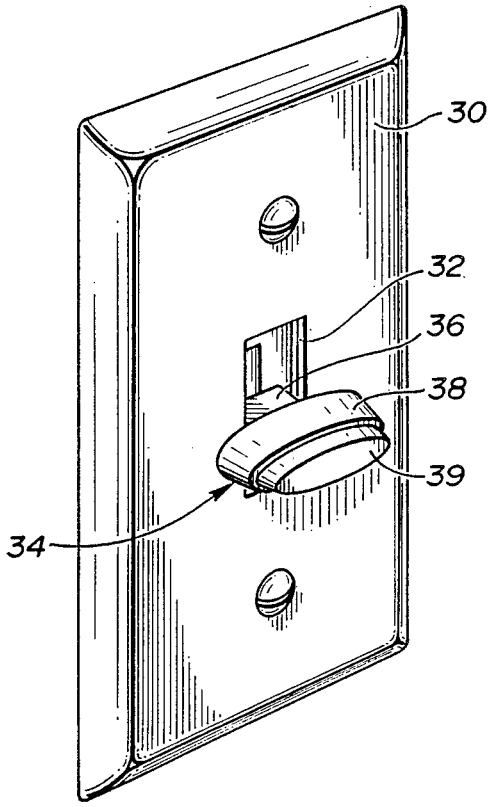
FIG. 2 depicts another embodiment of this invention.

FIG. 2 depicts another embodiment of this invention, in which the faceplate 30 has a standard "toggle switch" opening 32 that is approximately 25 mm high × 12 mm wide. Slider 34 comprises shaft 36, which may be the shaft of a slide potentiometer, and bezel 38. The entire dimming range is accomplished by moving slider 34 up and down within opening 32. Pushbutton 39 moves in and out within bezel 38 to actuate the pushbutton switch. Preferably, pushbutton 39 must be pushed in a distance greater than about 1 mm before actuating the switch, so that the switch is not accidentally actuated by a person who brushes against the pushbutton. As depicted in FIG. 2, slider 34 does not cover the opening 32 in faceplate 30, unlike the situation for the embodiment of FIG. 1, discussed above.

When the switch and dimmer of this invention are mounted in a wallbox, the slider moves generally up and down and the pushbutton moves generally in and out, in a direction normal to that of the slider. Since the switch itself remains stationary in the backbox, it is advantageous to have a mechanism that insures that the pushbutton force will always provide an "inward" force (toward the wallbox) regardless of the slider position. One way to accomplish this force transmission is through the use of the pivoted hinge bar depicted in FIG. 3.

Figure 3:
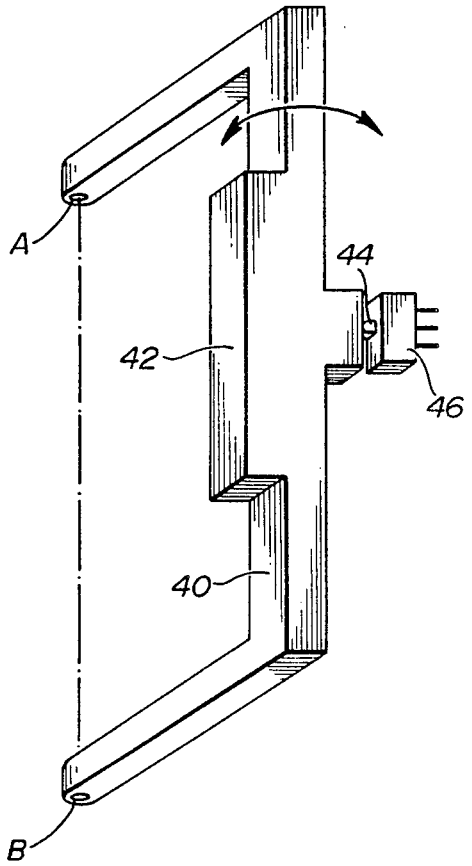
FIG. 3 depicts a force-transmitting mechanism of an embodiment of this invention.

The mechanism shown in FIG. 3 comprises a C-shaped hinge bar 40, which is mounted on collinear pins A and B, which constrain the bar to rotate about an axis through the pins. A bottom surface of the pushbutton rides on surface 42 of the hinge bar as the slider is moved up and down. Regardless of its position along surface 42, the pushbutton, when depressed, always provides a force along the axis of switch plunger 44, thereby actuating the switch 46. Although surface 42, is depicted in FIG. 3 as being an elongated surface, along which a pushbutton on a linear slider (34 in FIG. 2) would move; it is clear that the surface 42 could alternatively be a section of a flattened ring-shaped surface, along which a pushbutton on a rotary potentiometer shaft would move. In that case, pins A and B would be at the endpoints of a chord of the ring.

Figure 4:
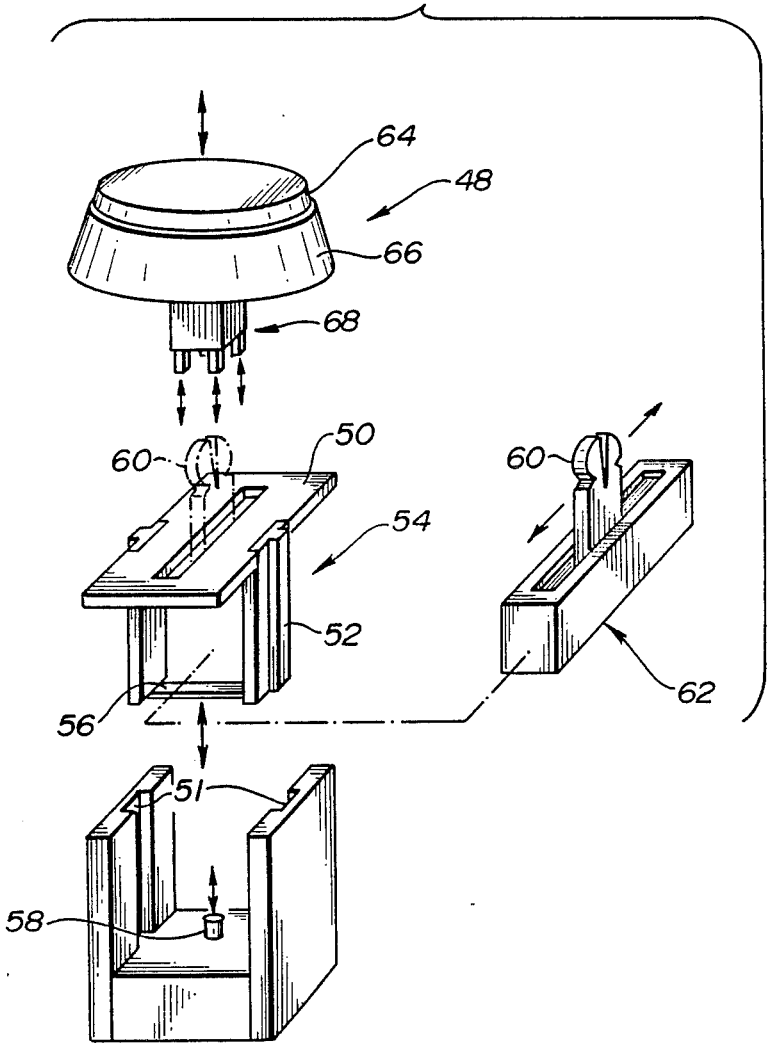
FIG. 4 depicts an alternative embodiment of the mechanism shown in FIG. 3.

FIG. 4 depicts an alternative force-transmission mechanism for providing a switch force that is always along a stationary axis, regardless of slider position. In that embodiment, knob 48, which is preferably replaceable, slides back and forth along surface 50, which is held by tongue 52 and groove 51. Thus, regardless of the point along surface 50 at which pushbutton 64 is depressed, base 56 of frame 54 always provides a force along the axis of switch plunger 58 to actuate the switch (not shown). Although knob 48 rides on the shaft 60 of linear slide potentiometer 62, when pushbutton 64 is depressed, bezel 66 and shaft 60 remain stationary and surface 50 is pushed by pushbutton feet 68 that emerge from the bottom of knob 48. Although surface 50 is depicted as being an elongated surface, along which moves knob 48 on shaft 60 of linear slide potentiometer 62; it is clear that surface 50 could be the flat top of a circular disk, along which a knob on the shaft of a rotary potentiometer could move. An advantage of the device depicted in FIG. 4 is that it can be very compact.

Figure 5:
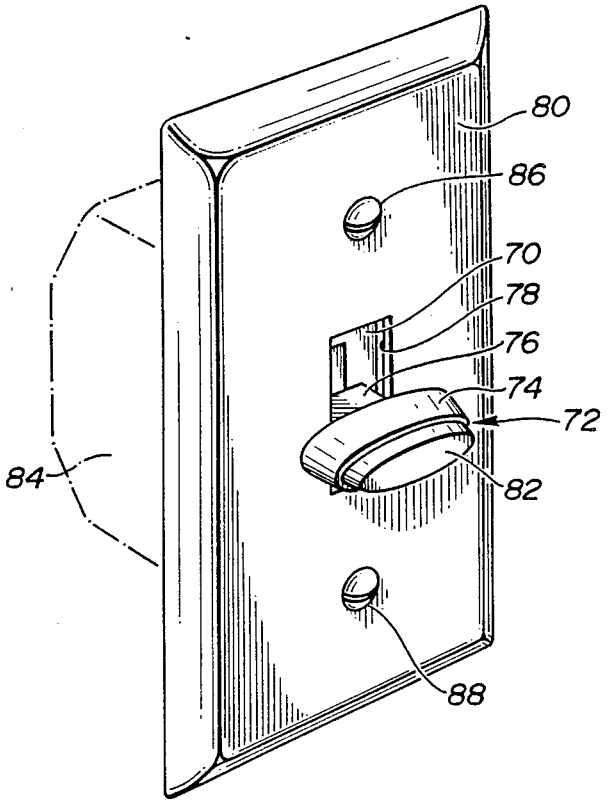
FIG. 5 depicts a switch of the present invention.

FIG. 5 depicts an embodiment of a switch (alone) of the present invention. Support plate 70 is adapted for mounting in a conventional wallbox (not shown). Switch actuator 72 comprises bezel 74 which is attached to support plate 70 by shaft 76, which passes through slot 78 in faceplate 80. When depressed, pushbutton 82 rides in bezel 74 to actuate a switch (in backbox 84), which is an alternate-action mechanical power switch. Although bezel 74 is depicted in FIG. 5 as having a size of the same order as slot 78, it could alternatively be substantially larger; for example extending over faceplate mounting screws 86 and 88 or over the entire faceplate 80, to provide a smooth appearance, without mounting screws. With a larger bezel, pushbutton 82 could likewise be larger. For ease of mounting a larger bezel, shaft 76 could be in two parts that snap together. One part could be mounted on support plate 70 and the other part attached to bezel 74.

An electrical circuit and load that are appropriate for the present invention are illustrated in the above-mentioned U.S. Pat. No. 4,563,592, issued to Yuhasz et al., and incorporated herein by reference. In particular, FIG. 3 and the associated description that appears in columns 6 and 7 of that patent provide a clear picture of a conventional circuit and load that are suitable for the present invention. Of course, the present invention is by no means limited to that circuit and load, and alternative circuits and loads are well known.

Figure 6:
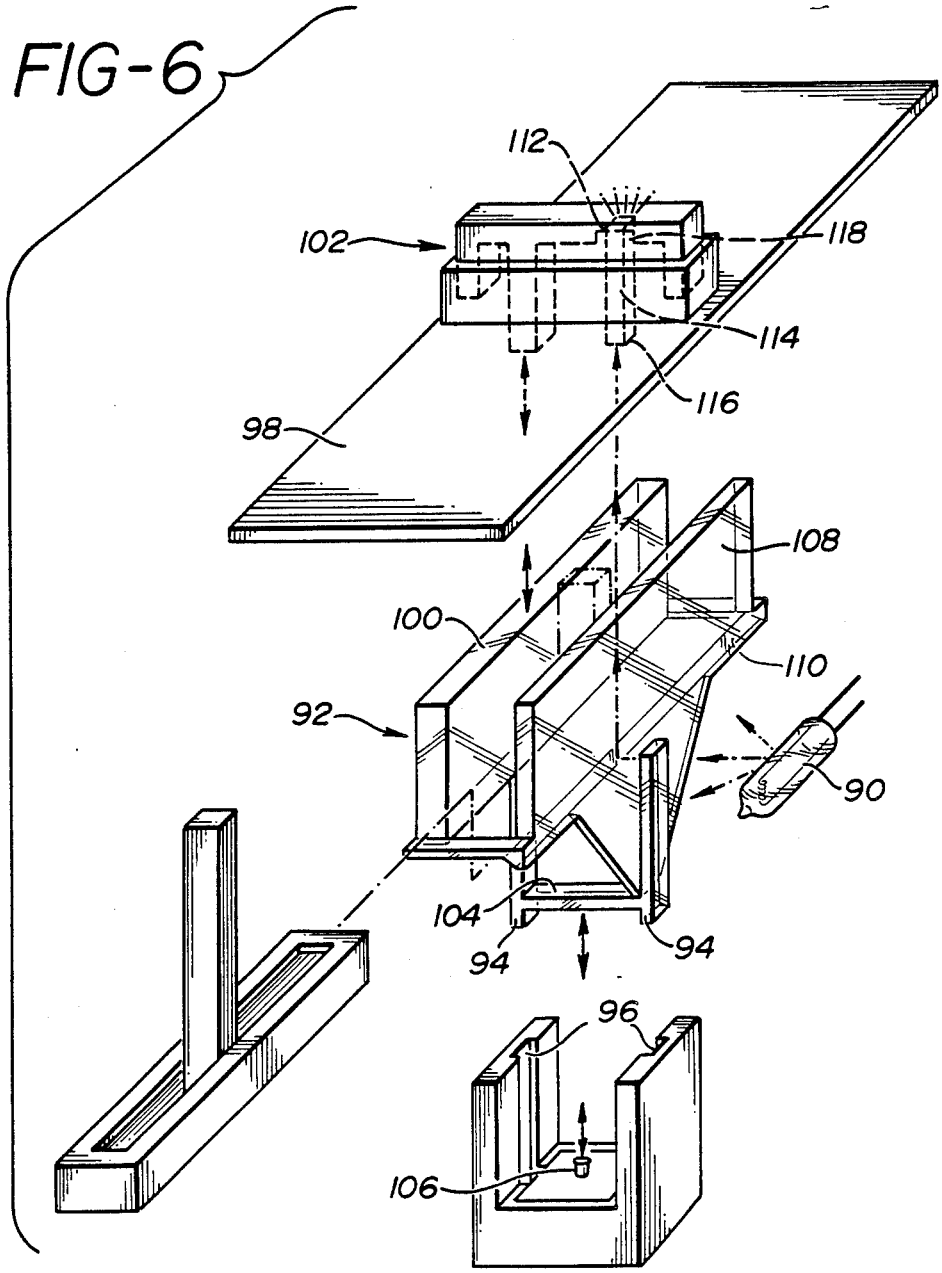
FIG. 6 depicts a variation on the mechanism shown in FIG. 4.

FIG. 6 depicts a variation on the mechanism shown in FIG. 4, which provides a hidden night light; i.e., a light that is designed to be visible only in a darkened environment. The light emanates from lamp 90, which is preferably a neon lamp. Neon is preferred, because these lamps combine long life with the low-current operation needed to meet UL listing requirements.

Frame 92 has tongues 94, which are constrained by stationary grooves 96. Slider 98 can move back and forth along surface 100 of frame 92. Regardless of the position of slider 98 along surface 100, when pushbutton 102 is depressed, element 104 of frame 92 provides a force along the axis of switch plunger 106 to actuate the switch (not shown). Lamp 90 could be located directly below pushbutton 102. Alternatively, as shown in FIG. 6, lamp 90 is horizontally offset. A section of wall 108 is transparent and face 110 makes an angle of 45° with the horizontal (which is greater than the critical angle for total internal reflection for the medium of the section); thus, light from lamp 90 is reflected up through the transparent section of wall 108 and through pushbutton 102. Face 110 may have an opaque, reflective back coating.

Optionally, as shown in FIG. 6, pushbutton 102 is formed of a generally opaque material and has a recess, which leaves a thin section 112 adjacent to the front surface of the pushbuton. When lamp 90 is on, light can be seen from a point in front of pushbutton 102. The intensity of that light depends on the lamp output, the optical system between lamp and pushbutton, the light-transmitting properties of the pushbutton material, and the geometry of the recess and thin section. These parameters can be adjusted so that the light is visible in a darkened environment. If the pushbutton is of a thermoplastic, molding is a preferred forming process. In that case, the recess preferably extends over an area that is a relatively small fraction of the top area of the pushbutton, which permits the thin section thickness to be a minimum, less than about 1 mm. If the recess extends over too large an area, the thin section cannot easily be molded and, furthermore, would be mechanically weak. The optimum recess area for the required section thickness depends on the thermoplastic material and can be determined by routine experimentation.

Optional light pipe 114 provides higher light intensity, if that is desirable. Still higher light intensity is provided if the lower end 116 of light pipe 114 has a larger lateral dimension than does upper end 118, adjacent to the thin section. Lamp 90 is depicted in FIG. 6 as a stationary source, which is elongated to provide desirably constant light through pushbutton 102, regardless of the position of slider 98. Alternatively, lamp 90 could be joined to slider 98 and move with it to, likewise provide substantially constant light. If desirable, the power to lamp 90 could be user-adjustable, either mechanically (e.g., filters) or electrically (e.g., a light dimmer). The transparent section of wall 108 could be a light pipe and could further provide enhanced light output by having a smaller lateral dimension at the top—near slider 98—than at the bottom. Although wall 108 is shown in FIG. 6 as an element of frame 92, its elements—i.e., transparent section and reflective face—could alternatively be attached to pushbutton 102.

Figure 7:
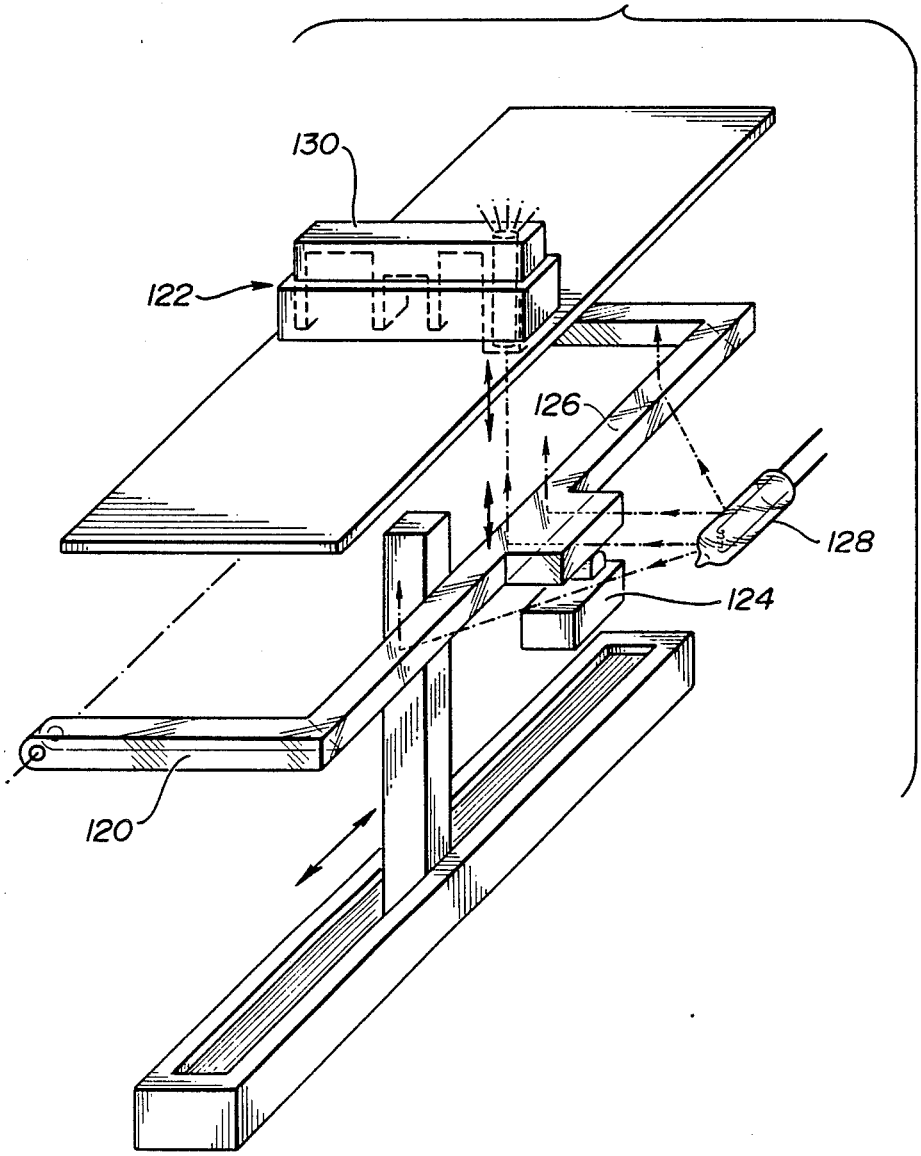
FIG. 7 depicts a variation on the mechanism of FIG. 3.

FIG. 7 depicts a variation on the mechanism of FIG. 3 for providing light through a pushbutton of this invention. In this embodiment, hinge bar 120 provides a means for transmitting a force between pushbutton 122 and switch 124. Hinge bar 120 has a transparent section and a reflective face 126 at 45° to the horizontal to reflect light from lamp 128 through pushbutton 130. The transparent section of hinge bar 120 could have a narrow lateral extent and provide a light pipe to enhance the intensity of light to the pushbutton. Although elements 108 of FIG. 6 and 120 of FIG. 7 preferably have transparent sections, it is often more convenient to form them entirely of a transparent material.

Figure 8:
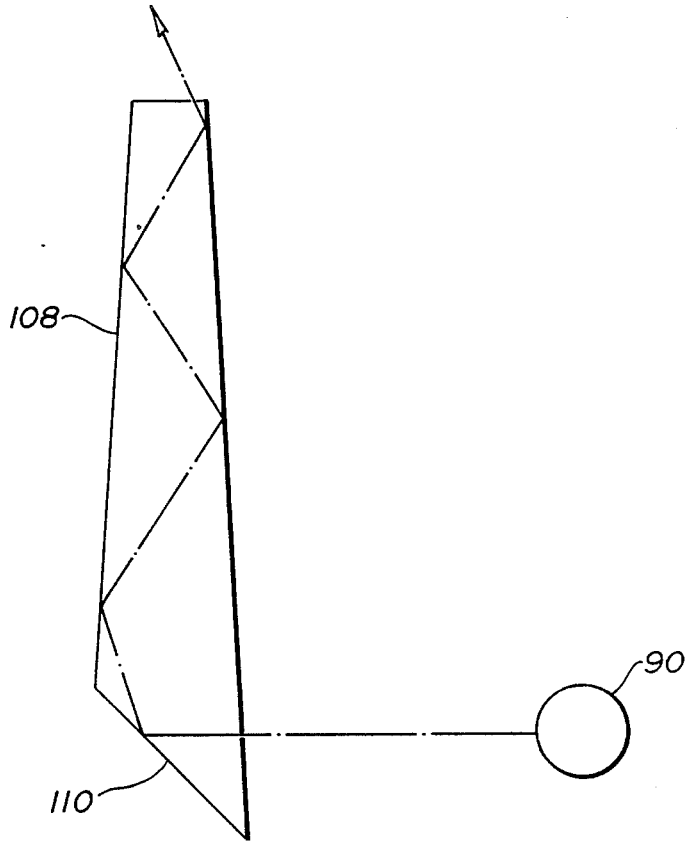
FIG. 8 depicts total internal reflection.

Preferably, the light intensity through the pushbutton of the embodiment of FIGS. 6 and 7 is enhanced by total internal reflection in the element(s) that direct the light from the lamp to the pushbutton, as is depicted for element 108 (in a wedge-shaped embodiment) in FIG. 8.

The present invention having been described in connection with preferred embodiments, many variations and modifications will now become apparent to those skilled in the art. Therefore, the present invention is to be limited not by the specific disclosure, but only by the appended claims.

We claim:

1. A dimmer-and-switch system for controlling power to an electrical load, in which (a) said dimmer comprises a sliding member positionable linearly along a first direction for determining the power provided to said load, (b) said switch comprises a pushbutton-actuated switch and means for transmitting a force applied to said pushbutton to actuate said switch, and (c) said pushbutton moves with said sliding member along said first direction and is actuated by being pushed in a second direction, substantially normal to said first direction, whereby said force can actuate said switch regardless of the position of said sliding member.

2. The system of claim 1, in which said dimmer and switch are adapted for mounting in a wallbox.

3. The system of claim 1, in which said sliding member moves up and down only.

4. The system of claim 1, in which said sliding member comprises a slide potentiometer shaft.

5. The system of claim 4, in which said shaft is adapted for passing through a rectangular slot about 12 mm wide.

6. The system of claim 5, in which said dimmer is operated by moving said shaft over a range of about 25 mm.

7. The system of claim 1, in which said pushbutton is captured in said sliding member.

8. The system of claim 1, in which said pushbutton is biased.

9. The system of claim 8, in which said pushbutton must be depressed a distance greater than about 1 mm to actuate said switch.

10. The system of claim 1, in which said switch is an alternate-action switch.

11. The system of claim 1, in which said pushbutton is a part of a replaceable knob.

12. The system of claim 1, in which said switch is a touch switch.

13. The system of claim 1, in which said switch is a mechanical power switch.

14. The system of claim 1, in which said force-transmitting means comprises a pivoted hinge bar.

15. The system of claim 1, in which said force-transmitting means comprises a fixed elongated slot having a long dimension parallel to said second direction and a frame attached to said pushbutton and constrained to move in said slot.

16. The system of claim 1, further comprising an indicator lamp.

17. The system of claim 16, in which said lamp is a light-emitting diode.

18. The system of claim 17, in which said light-emitting diode moves with said sliding member.

19. A wallbox-mountable device for controlling power to an electrical load, comprising, in combination:

(a) a dimmer that includes a manually-movable member for determining the power provided to said load, (b) a switch means that includes a pushbutton and a switch, said pushbutton adapted for moving with said manually-movable member in a first direction and for actuating said switch by being pushed in a second direction, substantially normal to said first direction, and (c) a light source for providing light through said pushbutton in said second direction.

20. The device of claim 19 in which said switch is a mechanical power switch.

21. The device of claim 19 in which said pushbutton is formed of a generally opaque material and has a front surface and rear surface, said rear surface being interrupted by a recess that extends toward said front surface, whereby a thin section of material remains adjacent said front surface, said thin section of material having a light opacity and the intensity and direction of light provided by said light source being such that said light is capable of being seen from a position in front of said front surface when said light source is on.

22. The device of claim 21 in which said pushbutton comprises a molded thermoplastic material and said recess dimensions are selected to permit said thin section to have a thickness less than about 1 mm.

23. The device of claim 21 in which said recess is elongated in said second direction, said pushbutton further comprises an elongated transparent member within said recess, and said light source provides light in a direction whereby said light is totally internally reflected within said transparent member.

24. The device of claim 23 in which said transparent member has a front end adjacent to said thin section and an opposite end more distant from said thin section, said front end having a lateral dimension that is smaller than said lateral dimension of said opposite end.

25. The device of claim 19 in which said light source comprises a neon lamp.

26. The device of claim 19 further comprising means for adjusting the intensity of light from said light source through said pushbutton.

27. The device of claim 19 in which said light source moves with said manually movable member in said first direction.

28. The device of claim 19 in which said light source is substantially stationary.

29. The device of claim 28 in which said light source is elongated in said first direction.

30. The device of claim 19 in which said pushbutton further comprises a reflecting means to direct light emitted by said light source through said pushbutton.

31. The device of claim 19 further comprising means for transmitting a force applied to said pushbutton to actuate said switch.

32. The device of claim 31 in which said force-transmitting means comprises a pivoted hinge bar.

33. The device of claim 31 in which said force-transmitting means comprises a fixed elongated slot having a long dimension parallel to said second direction and a frame means constrained to move in said slot.

34. The device of claim 31, 32, or 33 in which said force-transmitting means comprises a light-transmitting section.

35. The device of claim 34 in which said light-transmitting section is adapted for accepting light from said light source and passing said light toward said pushbutton by total internal reflection.

36. The device of claim 35 in which said light-transmitting section has a front end adjacent to said pushbutton and an opposite end more distant from said pushbutton, said front end having a lateral dimension that is smaller than said lateral dimension of said opposite end.

37. The device of claim 34 in which said light-transmitting section further comprises a reflecting means to direct light emitted by said light source toward said pushbutton.

38. The device of claim 37 in which said reflecting means comprises a planar face of said light transmitting section to direct said light by total internal reflection.

39. The device of claim 37 in which said reflecting means comprises a substantially opaque face of said light transmitting section.

40. A wallbox-mountable device for controlling power to an electrical load, comprising, in combination:

(a) a switch means that includes a pushbutton and a switch, (b) a potentiometer that includes a manually movable member for determining the power provided to said load, and (c) a pivoted hinge bar for transmitting a force applied to said pushbutton to actuate said switch, said movable member being adapted for moving with said pushbutton along said hinge bar.

41. The device of claim 40 in which said potentiometer is a rotary potentiometer.

42. The device of claim 40 in which said potentiometer is a linear slide potentiometer.

43. The device of claim 40 further comprising a faceplate for covering said device when mounted in a wallbox, said faceplate having a front that is away from the wall when the device is mounted in said wallbox, said pushbutton, manually movable member, and faceplate being the only elements of said wall-mounted potentiometer and switch that are visible when said device is viewed from the front of said faceplate.

44. A wallbox-mountable device for controlling power to an electrical load, comprising, in combination:

(a) a switch means that includes a pushbutton and a switch, (b) a potentiometer that includes a member manually movable in a first direction for determining the power provided to said load, and (c) means for transmitting a force applied to said pushbutton to actuate said switch, said force transmitting means including a fixed elongated slot, having a long direction that is substantially normal to said first direction, and a frame means constrained to move in said slot, said movable member being adapted for moving with said pushbutton along said frame means.

45. The device of claim 44 in which said potentiometer is a rotary potentiometer.

46. The device of claim 44 in which said potentiometer is a linear slide potentiometer.

47. The device of claim 44 further comprising a faceplate for covering said device when mounted in a wallbox, said faceplate having a front that is away from the wall when the device is mounted in said wallbox, said pushbutton, manually movable member, and faceplate being the only elements of said wall-mounted potentiometer and switch that are visible when said device is viewed from the front of said faceplate.

48. A wallbox-mountable device for controlling power to an electrical load, comprising, in combination:

(a) a linear slide potentiometer that includes a manually-movable member for determining the power provided to said load, (b) a switch means that includes a pushbutton and a switch, said pushbutton adapted for moving with said manually-movable member in a first direction and for actuating said switch by being pushed in a second direction, substantially normal to said first direction, and (c) rail means deployed along said first direction for transmitting a force applied to said pushbutton to actuate said switch.

* * * * *